US006628248B2

(12) United States Patent
Masumoto et al.

(10) Patent No.: US 6,628,248 B2
(45) Date of Patent: Sep. 30, 2003

(54) IMAGE DISPLAY APPARATUS AND METHOD FOR COMPENSATING DISPLAY IMAGE OF IMAGE DISPLAY APPARATUS

(75) Inventors: Junji Masumoto, Osaka (JP); Shigekazu Yamagishi, Osaka (JP); Hitoshi Noda, Osaka (JP); Atsushi Hatakeyama, Osaka (JP); Hiroshi Miyai, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 265 days.

(21) Appl. No.: 09/903,247

(22) Filed: Jul. 11, 2001

(65) Prior Publication Data

US 2001/0048406 A1 Dec. 6, 2001

(51) Int. Cl.[7] ..... G09G 3/00
(52) U.S. Cl. ..... 345/32; 345/207
(58) Field of Search ..... 345/207, 32, 7, 345/3.4, 48, 83; 348/744, 745, 195; 359/196

(56) References Cited

U.S. PATENT DOCUMENTS 5,097,324 A * 3/1992 Tanaka et al. ..... 348/760
5,386,253 A * 1/1995 Fielding ..... 348/745
5,502,490 A * 3/1996 Takanashi et al. ..... 358/296
5,867,152 A * 2/1999 Sextro ..... 345/207
6,084,235 A * 7/2000 Breithaupt et al. ..... 250/233
6,535,207 B1 * 3/2003 Hiroki ..... 345/207

FOREIGN PATENT DOCUMENTS

JP 5-165422 7/1993

* cited by examiner

*Primary Examiner*—Regina Liang
(74) *Attorney, Agent, or Firm*—Merchant & Gould, P.C.

(57) ABSTRACT

An image display apparatus is provided for enlarging and projecting a light emitted from a plurality of self-emitting elements on a screen by beam scanning means, which is an image display apparatus having little or no luminance unevenness by solving the conventional problem of causing luminance unevenness in images projected on the screen due to a variance in luminance characteristics of each self-emitting element. It is configured such that a part of the light scanned on the screen from the beam scanning means is provided to a photodetector element that converts the intensity of the light into an electric signal so as to correct a driving signal to be supplied to the self-emitting element by the intensity of the light detected by this photodetector element.

27 Claims, 13 Drawing Sheets

101 Lamp
102 Reflector
103 Focusing lens
104, 105 Dichroic mirror
106, 107, 108 Total reflection mirror
109, 110, 111 Lens
112 Red liquid crystal panel
113 Green liquid crystal panel
114 Blue liquid crystal panel
115 Color composition prism
116 Projection lens
117 Screen

IMAGE DISPLAY APPARATUS AND METHOD FOR COMPENSATING DISPLAY IMAGE OF IMAGE DISPLAY APPARATUS

BACKGROUND OF THE INVENTION

1. Field of the Invention

The present invention relates to an image display apparatus that displays images by projecting a light modulated and emitted from a light source on a screen.

2. Description of the Related Art

In recent years, along with the enrichment of image equipment such as a video tape recorder, a video disc player and video software, there has been a growing demand for a large screen image display apparatus to enjoy images with more impact. As a conventional large screen image display apparatus, there is an image display apparatus that projects images on a screen or the like by using a liquid crystal panel for the image display part and spatially modulating the light emitted from a light source with the light crystal panel.

FIG. 13 is a configuration diagram showing an example of a conventional image display apparatus using a liquid crystal panel for the image display part.

In FIG. 13, after a light emitted from a lamp 101 serving as a light source and a reflected light reflected by a reflector 102 are focused on a focusing lens 103, the light is decomposed into three primary colors of red, green and blue by color separating dichroic mirrors 104, 105. Each primary color is led by a red liquid crystal panel 112, a green liquid crystal panel 113 and a blue liquid crystal panel 114, and after the colors are composed by a color composition prism 115, they are projected on a screen 117 by a projection lens 116. Furthermore, total reflection mirrors 106, 107, 108 are provided to change the optical path of the light beam, and lenses 109, 110, 111 are provided to adjust the angle of the light beam entering each liquid crystal panel. With respect to the lamp used as the light source, white light sources such as a discharge-type extra-high pressure mercury lamp, a metal halide lamp or a thermoluminescence-type halogen lamp are used.

The red liquid crystal panel 112, the green liquid crystal panel 113 and the blue liquid crystal panel 114 are driven by a red picture signal, a green picture signal and a blue picture signal respectively. The light emitted from the lamp 101 is modulated spatially when passing through each liquid crystal panel and projected as images on the screen 117 by the projection lens 116.

In the above-mentioned conventional configuration, the images are displayed by driving the liquid crystal panels with the picture signals and changing the transmittance of the light by the liquid crystal panels. However, since the light blocking performance of the liquid crystal panels is not perfect, the display performance in low gray scale images was bad, so that it was difficult to obtain high-quality images. Furthermore, most of the lamps used at present have low light utilization efficiency, which is a ratio of emitted light in proportion to introduced electricity, so that high-intensity lamps must be used to obtain bright projected images. Therefore, there was a problem in that the power consumption increased, and that the heating from the lamp also rose.

To solve these problems, an image display apparatus, which is characterized by having light-emitting means including a plurality of self-emitting elements radiating respectively in red, green and blue according to an electric picture signal corresponding to information of images to be displayed, beam scanning means for scanning the light emitted from the light-emitting means in an arbitrary direction, and image formation means for forming the light emitted from the light-emitting means into images on a screen, is proposed.

However, although the conventional problems are solved with the image display apparatus in which a plurality of self-emitting elements are arranged as described above, due to the fact that a plurality of self-emitting elements are used for each color, the variance of emission luminance characteristics of each of the self-emitting elements caused the problem of increasing unevenness in luminance or in color for the images projected on the screen.

SUMMARY OF THE INVENTION

In order to achieve the aforementioned object, an image display apparatus of the present invention comprises light-emitting means including a plurality of light-emitting elements that modulate an intensity of a self-emitting light radiating respectively in red, green and blue according to an electric picture signal corresponding to information of images to be displayed, the light-emitting elements being arranged in a line according to each color, focusing means for focusing the light emitted from the light-emitting means, projection means for enlarging and projecting the light focused by the focusing means, beam scanning means for scanning the light projected by the projection means on a screen by a beam scanning means driving circuit, to which an output signal is input from a synchronous processing circuit, a synchronous signal being input from outside to the synchronous processing circuit, photodetector means having at least one photodetector element for receiving the light emitted from the light-emitting means, a comparator for comparing the individual intensity of the light, to which an intensity of the light received by the photodetector means is input on one side, and to which an intensity of a light serving as reference is input on the other side, a correction circuit for correcting an output signal from an image circuit, to which a picture signal synchronized with the synchronous signal based on the result of the comparator is input, and a light-emitting means driving circuit for driving the light-emitting means, to which an output from the correction circuit is input. According to the image display apparatus described above, the variance in the emission luminance characteristics can be corrected, and luminance unevenness of images projected on a screen can be prevented from occurring.

In the aforementioned image display apparatus, it is preferable that the photodetector means is positioned outside an effective image area of the screen and receives the light scanned by the beam scanning means. According to the image display apparatus described above, the photodetector means does not block the screen, so that it is not necessary to move the photodetector means in both cases of displaying images and receiving light. Thus, the task of adjusting luminance unevenness is simplified.

Furthermore, it is preferable that the photodetector means includes a plurality of photodetector elements arranged in lines, and that each of the photodetector elements receives a light for one set of red, green and blue light-emitting elements of the light-emitting means. According to the image display apparatus described above, the cost and the number of man-hours can be reduced compared to the case of arranging a photodetector element for each light-emitting element.

Furthermore, it is preferable that light-emitting elements other than the light-emitting element involved in the light for one set do not emit light when receiving the light for the one set. According to the image display apparatus described above, the other light-emitting elements are not affected by the light, so that the deterioration of detection accuracy can be prevented.

Furthermore, it is preferable that the photodetector element receives light from plural sets of the light-emitting elements simultaneously by allowing one set of the light-emitting elements located in portions separated at a predetermined distance to emit light. According to the image display apparatus described above, the detection time can be reduced while preventing the detection accuracy from deteriorating.

Furthermore, it is preferable to provide a control circuit for controlling the beam scanning means driving circuit, to which an arbitrary detection signal is input. According to the image display apparatus described above, it is possible to correct luminance unevenness at any time.

Furthermore, it is preferable that the control circuit is a circuit that controls the beam scanning means driving circuit such that the light enlarged and projected by the projection means is emitted to the photodetector means by the beam scanning means when the detection signal is input, and controls the beam scanning means driving circuit so as not to emit the light to the photodetector means when the detection signal is not input.

Furthermore, it is preferable that the beam scanning means driving circuit is controlled such that when the detection signal is input, and in the case where it is judged that a correction of an output signal from the image circuit is required, the light enlarged and projected by the projection means is emitted to the photodetector means by the beam scanning means. According to the image display apparatus described above, luminance unevenness is adjusted only in the case where it is judged as necessary. Therefore, compared to the case, for example, of adjusting luminance unevenness every time a power source is introduced, the length of the period until correct images are displayed on the screen by the adjustment of luminance unevenness can be minimized.

Furthermore, it is preferable that an arrangement position of the photodetector means can be changed, the photodetector means receiving the light scanned by the beam scanning means on the screen. According to the image display apparatus described above, the detection accuracy can be improved.

Furthermore, it is preferable that an arrangement position of the photodetector means can be changed, the photodetector means receiving the light emitted from the light-emitting means in the vicinity of the focusing means. According to the image display apparatus described above, the photodetector means can be positioned near the focusing means that focuses the light emitted from the light-emitting means on one point, so that the apparatus can be constructed with one photodetector element. Accordingly, the cost can be reduced, and the number of man-hours for correcting the variance between the respective photodetector elements is no longer required. Furthermore, by constantly using the same photodetector elements at the time of adjusting a delivery, it is advantageous to suppress the variance of brightness between the image display apparatuses at the time of delivery.

Furthermore, it is preferable to provide means for inputting the light emitted from the light-emitting means to the photodetector means before the emitted light is enlarged and projected by the projection means. According to the image display apparatus described above, the light emitted from the light-emitting means can be focused on one point of the photodetector means, so that the apparatus can be constructed with one photodetector element. Accordingly, the cost can be reduced, and the number of man-hours for correcting the variance between the respective photodetector elements is no longer required. Furthermore, by constantly using the same photodetector elements at the time of adjusting a delivery, it is advantageous to suppress the variance of brightness between the image display apparatuses at the time of delivery.

Furthermore, it is preferable that the means for inputting the emitted light to the photodetector means is a translucent mirror that transmits the light emitted from the light-emitting means to the focusing lens and provides a part of the light emitted from the light-emitting means to the photodetector means.

Furthermore, it is preferable that the translucent mirror is positioned between the photodetector means and the focusing means. According to the image display apparatus described above, the light reflected from the translucent mirror can be focused, so that the photodetector element can be miniaturized, compared to the case of positioning the translucent mirror between the focusing means and the projection means in which the light reflected from the translucent mirror moves in the scattering direction.

Furthermore, it is preferable that the translucent mirror is positioned such that when the light from the light-emitting means is provided to the photodetector means, the light from the light-emitting means enters the translucent mirror forming an incident angle with respect to the translucent mirror, and that when the light from the light-emitting means is not provided to the photodetector means, the light from the light-emitting means forms an incident angle of 0 with respect to the translucent mirror. According to the image display apparatus described above, the light is provided to the photodetector element so as to correct luminance unevenness, and when images are projected on the screen, the incident angle of the light entering the translucent mirror is 0 degree, so that the reflected light component also is 0, and thus, substantially 100% of the light can be focused on the focusing means.

Furthermore, it is preferable to provide a translucent mirror driving circuit for controlling the translucent mirror, to which an arbitrary detection signal is input.

Furthermore, it is preferable to provide a reflector for focusing the light scanned by the beam scanning means and emitting the light to the photodetector means. According to the image display apparatus described above, it has become possible to miniaturize the casing for the image display apparatus and also to mount the luminance unevenness correction circuit even on a projection type projector not equipped with a screen. Moreover, by using a concave mirror as the reflector, the light scanned by the beam scanning means can be focused on one point, so that one photodetector element will be sufficient.

Furthermore, it is preferable that the photodetector means is positioned in a space on a side opposite to a reflecting surface of the light within a front and back space of the beam scanning means. According to the image display apparatus described above, it is more advantageous due to the miniaturization of the casing for the image display apparatus.

Furthermore, it is preferable to provide an arithmetic circuit that can change the intensity of the light serving as the reference, to which an output from the photodetector means is input. According to the image display apparatus described above, it is possible to suppress the condition in which the emission life of the light-emitting element becomes shorter with increasing speed due to an increase in the amount of driving current of the light-emitting element.

Furthermore, it is preferable that the arithmetic circuit calculates the intensity of the light serving as the reference based on a detection value of the intensity of the light detected from a part of the light-emitting elements among the light-emitting elements included in the light-emitting means. According to the image display apparatus described above, the computing time for calculating the reference value is shortened.

Furthermore, it is preferable to provide a detection circuit, to which an output from the light-receiving means is input, and from which the result thereof is output to the correction circuit. According to the image display apparatus described above, the DC offset component can be eliminated in the case of having an analog arithmetic element.

Furthermore, it is preferable that light-emitting elements of the light-emitting means are driven by an analog current, and the correction circuit adds a signal for counterbalancing a DC offset component superimposed on the correction circuit based on the output from the detection circuit in a state in which the light of all the light-emitting elements of the photodetector means is extinguished.

Furthermore, it is preferable that the light-emitting element is selected from a light-emitting diode element, an electroluminescence element, and a semiconductor element.

Furthermore, it is preferable that the beam scanning means uses a reflector or a prism for changing a direction of a light beam.

Next, a method for compensating display images of the image display apparatus comprising: light-emitting means including a plurality of light-emitting elements that modulate an intensity of a self-emitting light radiating respectively in red, green and blue according to an electric picture signal corresponding to information of images to be displayed, the light-emitting elements being arranged in a line according to each color, focusing means for focusing the light emitted from the light-emitting means, projection means for enlarging and projecting the light focused by the focusing means, beam scanning means for scanning the light projected by the projection means on a screen by a beam scanning means driving circuit, to which an output signal is input from a synchronous processing circuit is input, a synchronous signal being input from outside to the synchronous processing circuit, and a light-emitting means driving circuit for driving the light-emitting means is provided. The method comprises:

receiving the light emitted from the light-emitting means by using photodetector means having at least one photodetector element, comparing the individual intensity of the light, to which an intensity of the light received by the photodetector means is input on one side, and to which an intensity of a light serving as reference is input on the other side, correcting an output signal from an image circuit, to which a picture signal synchronized with the synchronous signal is input based on the result of the comparison, and driving the light-emitting means by the light-emitting means driving circuit, to which the corrected output signal is input. According to the aforementioned method for compensating display images of the image display apparatus, the characteristic variance of emission luminance of light-emitting elements can be corrected, and the occurrence of luminance unevenness in images projected on the screen can be prevented.

In the aforementioned method for compensating display images of the image display apparatus, it is preferable that the photodetector means receives light on the screen. According to the aforementioned method for compensating display images for an image display apparatus, the detection accuracy can be improved.

Furthermore, it is preferable that the photodetector means includes a plurality of photodetector elements arranged in lines, and that each of the photodetector elements receives a light for one set of red, green and blue light-emitting elements of the light-emitting means. According to the aforementioned method for compensating display images for an image display apparatus, the cost and the number of man-hours can be reduced, compared to the case of arranging a photodetector element for each light-emitting element.

Furthermore, it is preferable that the photodetector means receives the light in the vicinity of the focusing means. According to the aforementioned image display apparatus, the photodetector means can be positioned near the focusing means that focuses the light emitted from the light-emitting means on one point, so that the apparatus can be constructed with one photodetector element. Accordingly, the cost can be reduced, and the number of man-hours for correcting the variance between the respective photodetector elements is no longer required. Moreover, by constantly using the same photodetector elements at the time of adjusting a delivery, it is advantageous to suppress the variance of brightness between the image display apparatuses at the time of delivery.

DETAILED DESCRIPTION OF THE INVENTION

First Embodiment

Figure 2:
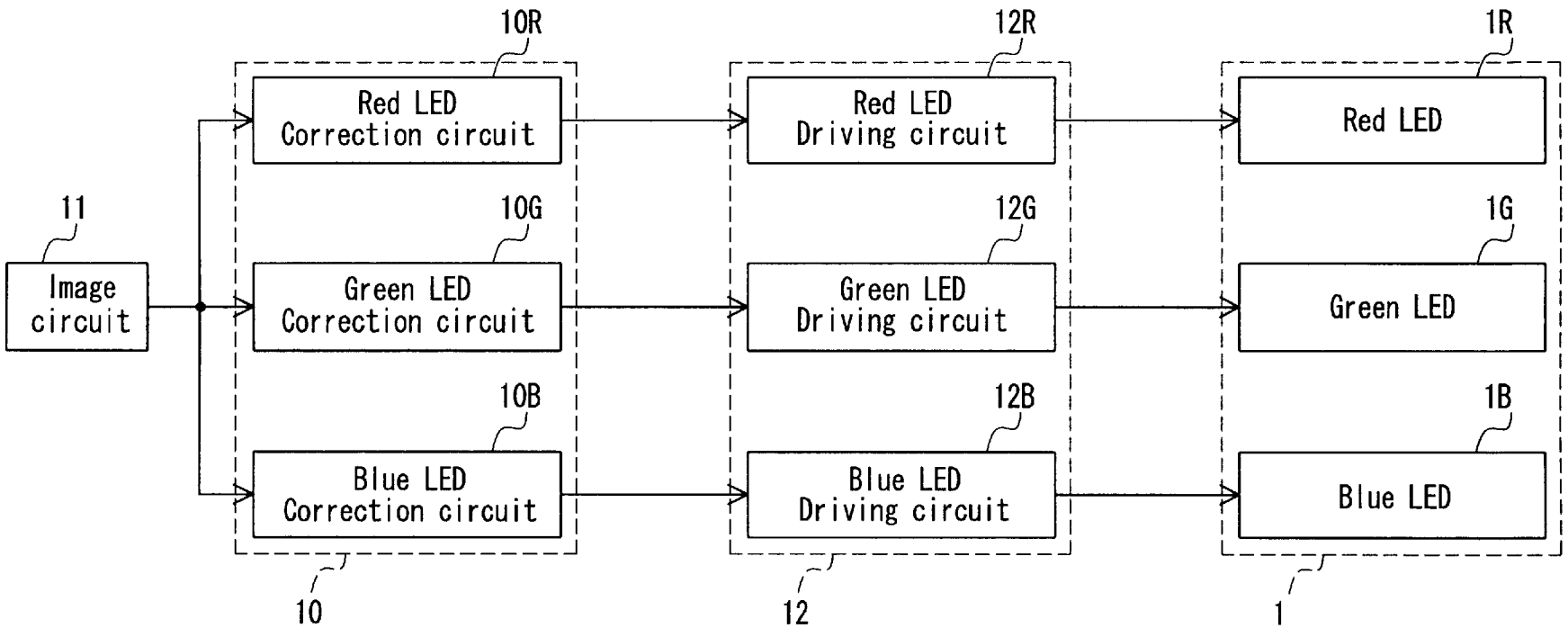
FIG. 2 is a diagram showing an example of a peripheral circuit in a light-emitting element according to the first embodiment of the present invention.
Figure 3:
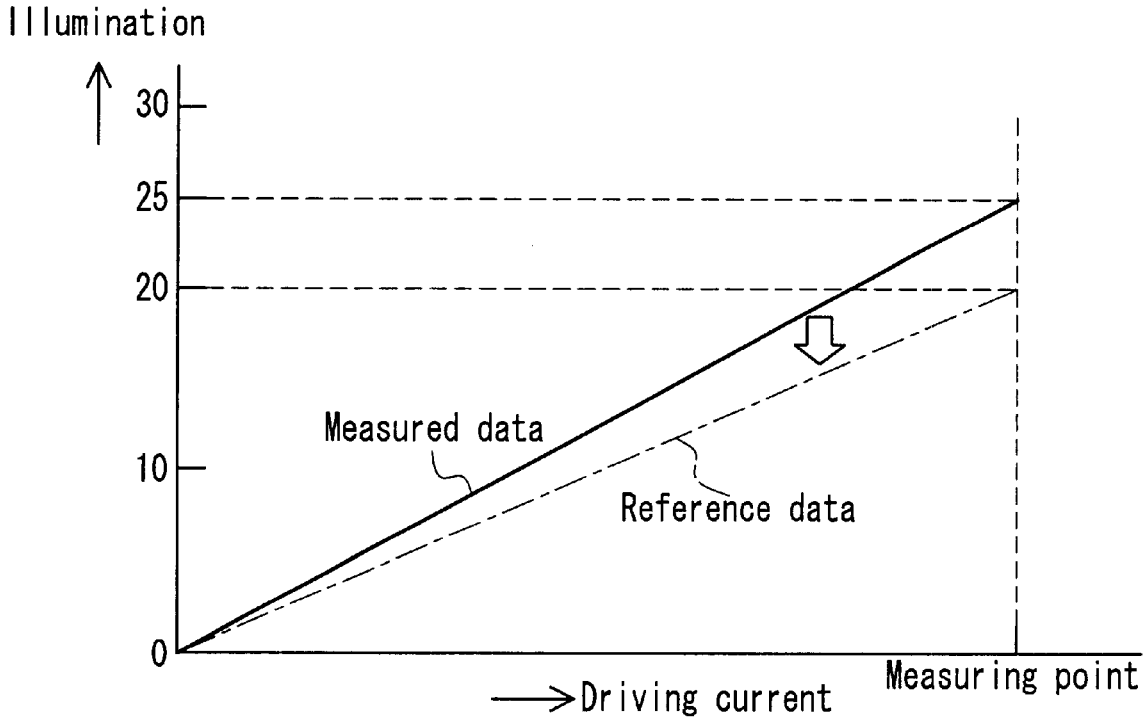
FIG. 3 is a graph for explaining the operation of the image display apparatus according to the first embodiment of the present invention.

In the following, an embodiment of the present invention will be described with reference to FIG. 1 to FIG. 3. In addition, the present embodiment will be described by using a light-emitting diode (hereinafter referred to as a LED) as the light-emitting element and a beam scanning reflector as the beam scanning means.

Figure 1:
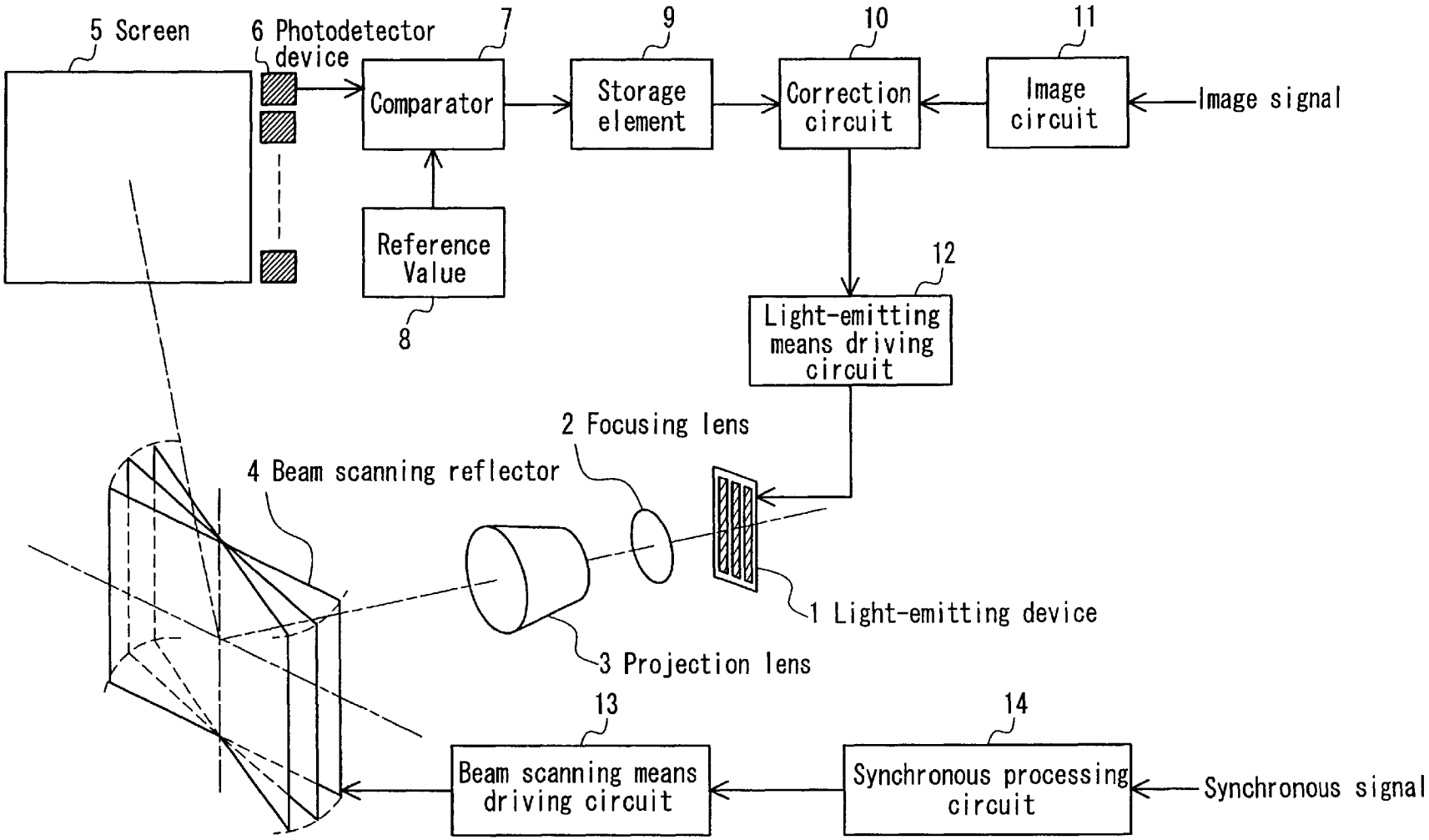
FIG. 1 is a block diagram of an image display apparatus according to a first embodiment of the present invention.

In FIG. 1, 1 is a light-emitting device serving as light-emitting means including a plurality of light-emitting elements arranged in a line according to each color that modulate an intensity of a self-emitting light radiating respectively in red, green and blue according to an electric picture signal corresponding to information of images to be displayed; 2 is a focusing lens for focusing the light emitted from the light-emitting device 1; 3 is a projection lens for enlarging and projecting the light focused by the focusing lens 2; 4 is a beam scanning reflector for scanning the light projected by the projection lens 3 in an arbitrary direction; 5 is a screen; 6 is a photodetector device serving as photodetector means for receiving the light scanned by the beam scanning reflector 4 and converting the intensity of this light into an electric signal; 7 is a comparator; 8 is a reference value serving as reference data for the comparator 7; 9 is a storage element for storing the result of comparing the signals input respectively to the comparator 7; 10 is a correction circuit; 11 is an image circuit; 12 is an light-emitting means driving circuit for driving the light-emitting device 1; 13 is a beam scanning means driving circuit for driving the beam scanning reflector 4; and 14 is a synchronous circuit. FIG. 2 shows a detailed circuit block diagram around the light-emitting device 1. In FIG. 2, the light-emitting device 1 includes a group of red LED 1R, which is a plurality of red light-emitting elements arranged in a line, a group of green LED IG, which is a plurality of green light-emitting elements arranged in a line, and a group of blue LED 1B, which is a plurality of blue light-emitting elements arranged in a line. Moreover, the light-emitting means driving circuit 12 also includes a red LED driving circuit 12R, a green LED driving circuit 12G, and a blue LED driving circuit 12B for respectively driving each LED group. Furthermore, the correction circuit 10 also includes a red LED correction circuit 10R, a green LED correction circuit 10G, and a blue LED correction circuit 10B. The operation of the image display apparatus according to the above configuration will be described below.

The light emitted from the light-emitting device 1 according to the electric picture signal corresponding to the information of images to be displayed is focused by the focusing lens 2, and this focused light is enlarged and projected by the projection lens 3. This enlarged projected light is projected on the image projecting screen 5 by the beam scanning reflector 4. In the case where each LED is arranged in a line in the vertical direction one by one for one horizontal line, for example, in the case of an image display apparatus with 480 lines such as NTSC (National Television System Committee) images, when 480 pieces of LED are arranged in a line in the vertical direction according to each color, by scanning the light enlarged and projected from the projection lens 3 by the beam scanning reflector 4 back and forth in the horizontal direction, it is possible to project desired images on the screen 5. Here, the beam scanning reflector 4 is driven by the beam scanning means driving circuit 13 according to the signal synchronized with a synchronous signal contained in a picture signal source connected to the present image display apparatus.

By providing the beam scanning means driving circuit 13 with means for scanning the light scanned by the beam scanning reflector 4 to the outside of the screen 5 serving as an effective image area (i.e. a horizontal blanking period area), the photodetector device 6 positioned in the horizontal blanking period area can receive the light scanned by the beam scanning reflector 4, and the intensity of the light emitted to the photodetector element can be detected. The intensity of the light detected as described above is converted into an electric signal by the photodetector element and input as comparative data to the comparator 7 to which the reference value 8 for the intensity of the light in the present image display apparatus is input on one side. By comparing the intensity of the light respectively input to the comparator 7, an error in the intensity of the light in the LED relative to the reference value 8 can be detected. The error data detected in this way are stored in each storage element for each LED device, and these error data are input to the correction circuit 10 to which the output from the image circuit 11 that conducted a signal processing of the picture signal contained in the picture signal source connected to the present image display apparatus is input on one side, and the picture signal output from the image circuit 11 is corrected in units of each line. As described above, the picture signal corrected by the correction circuit 10 is input to the light-emitting means driving circuit 12 to drive each LED device mentioned above.

Here, an example of a method for detecting the intensity of the light in each LED will be shown. In the case where the LEDs according to each color are arranged respectively for 480 pieces in the vertical direction, by arranging one photodetector element for one set of each red LED, green LED, blue LED included in one image line in the outside area of the screen 5 (i.e. the horizontal blanking period area) in the vertical direction in a total of 480 pieces, the intensity of the light in each LED can be detected. Here, the reason for using one photodetector element for one set of each red LED, green LED, blue LED is to reduce the cost and the number of man-hours for adjustment, and naturally, the intensity of the light can be detected also by arranging the photodetector element for each LED. The intensity of the light is detected by supplying only one piece of LED with a driving current serving as a reference and lighting it. At this time, the light of all the other LEDs is extinguished, so that the detection can be conducted without being affected by other LEDs. This operation is conducted sequentially for each LED to measure the intensity of the light in each LED. According to the method for measuring the intensity of the light in each LED as mentioned above, for the image display apparatus shown in the present embodiment in which 480 pieces of LED are arranged according to each color in the vertical direction, the cycle for detecting the intensity of the light in each LED is required for:

$$480 \text{ pieces} \times 3 \text{ colors} = 1{,}440 \text{ times}$$

and thus the problem of requiring an extremely long detection time arises. Therefore, as an example of countermeasures against the aforementioned problem, there is a parallel processing method in which the screen area is divided into upper and lower halves, and the first LED and the 241st LED are allowed to emit light simultaneously. Since the two LEDs have a sufficient spatial distance from each other even if the light is emitted simultaneously, this method can be achieved without deteriorating the accuracy for detecting the intensity of the light in the respective LEDs. As long as it is within the range in which the accuracy for detecting the intensity of the light is not deteriorated, it is needless to say that the same effect can be obtained even by increasing the number of the simultaneous parallel processing to 3 pieces, 4 pieces and so on.

Next, one example of correcting the intensity of the light in each LED detected as described above will be explained with reference to FIG. 3. The illumination characteristics relative to the driving current of the LED are approximated by the linear function as shown in FIG. 3, and furthermore, the LED naturally does not emit light when the driving current is 0 (i.e. brightness 0). When the reference brightness was 20 lux at the time when the driving current at the measuring point shown in FIG. 3 was supplied to the measuring element of the LED by the light-emitting means driving circuit 12, and when the brightness of the light received by the photodetector device 6 is 25 lux, this measuring element is judged to be about 25% brighter than the reference value. In other words, the line using this measuring element is brighter by 25% than the other lines, causing unevenness in luminance. Thus, by constantly supplying the measuring element with 0.8 times as much current as that for originally driving the measuring element, as shown in FIG. 3, the illumination characteristics relative to the driving current for the LED can be corrected from the characteristics indicated by the solid line of prior to correction to the reference characteristics (dashed line) of the present image display apparatus. In this way, the luminance unevenness as mentioned above is eliminated. In the present embodiment, the intensity characteristics of the light relative to the driving current for the LED were approximated linearly, but correction data of higher accuracy can be obtained by preparing a plurality of reference values and approximating it to a broken line. Furthermore, when the white balance of the present image display apparatus is achieved, a state in which the intensity of the light differs in red, green and blue normally is the ideal state. In other words, it is conceived easily that different reference values preferably are provided for each color.

In the present embodiment, the case of using a LED as light-emitting means was discussed in the explanation, but the same effect can be obtained also by using an electroluminescence device or a semiconductor laser device instead of the LED. Furthermore, as the beam scanning means for changing the optical path of the light beam, a movable reflector such as a galvano mirror or a polygon mirror was used for the explanation. However, as means for changing the optical path of the light beam, it is not limited to the reflector as described above, and the same effect can be obtained by using a prism or the like.

According to the configuration of the present invention described above, the conventional problem in that luminance unevenness is caused in images projected on the screen due to the variance in the illumination characteristics relative to the driving current of each LED is solved, and the display image of the image display apparatus can be compensated. That is, an image display apparatus capable of projecting uniform images with little or no luminance unevenness can be obtained.

Furthermore, the photodetector device 6 is positioned outside the effective image area of the screen 5 in the present embodiment, so that the photodetector device 6 does not block the screen 5. Thus, in both cases of displaying images and adjusting luminance unevenness, it is not necessary to move the photodetector device 6, and the procedure for adjusting luminance unevenness is simplified.

Second Embodiment

Next, a second embodiment of the present invention will be described with reference to FIG. 4. In addition, the same reference numerals will be used for the same components as those in the aforementioned embodiment, and the explanations thereof will be omitted.

Figure 4:
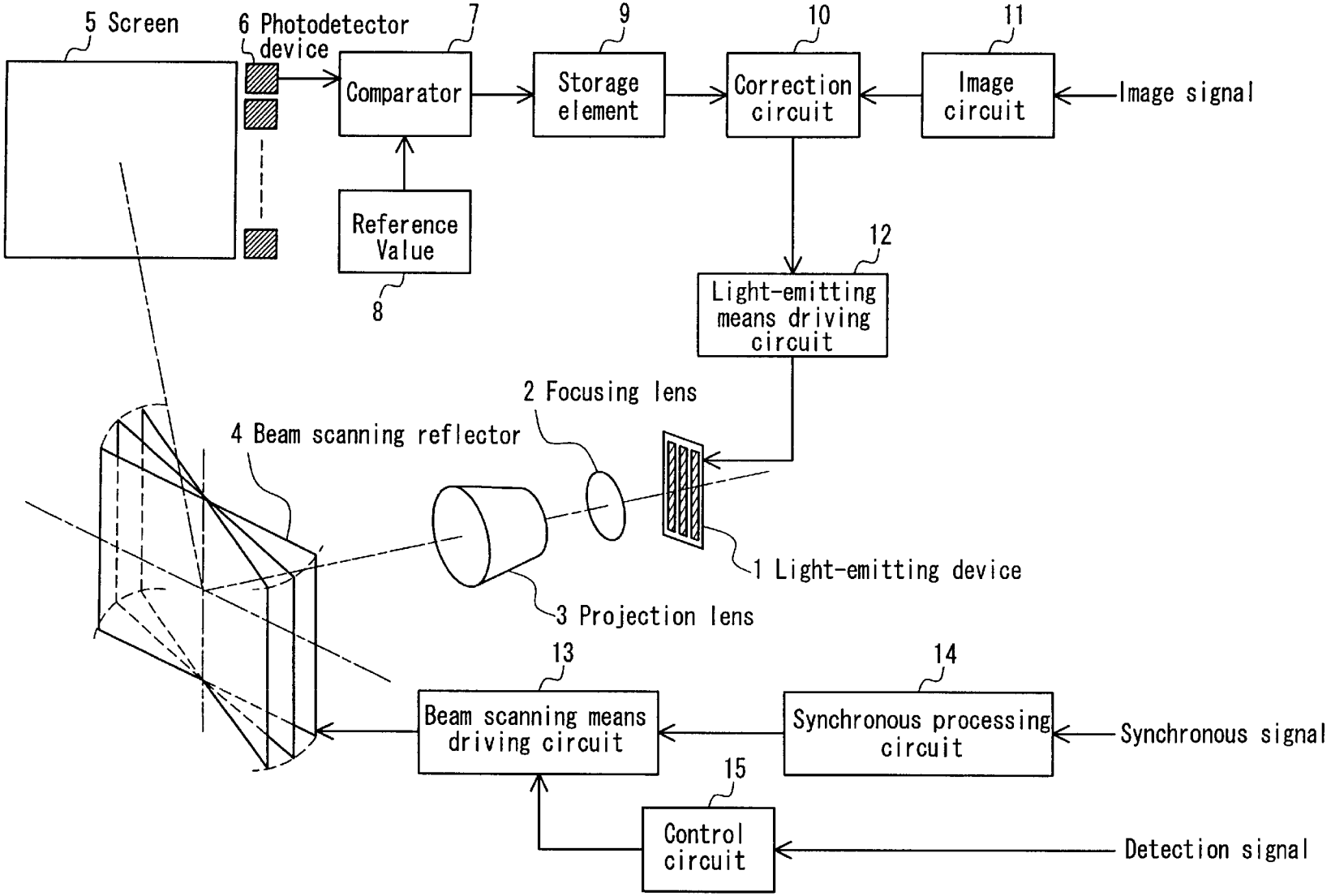
FIG. 4 is a block diagram of an image display apparatus according to a second embodiment of the present invention.

In FIG. 4, 15 is a control circuit for controlling the beam scanning means driving circuit 13 by inputting an arbitrary detection signal. The control circuit 15 is a circuit that controls the beam scanning means driving circuit 13 such that the light enlarged and projected by the projection lens 3 is emitted to the photodetector device 6 positioned outside the screen 5 by means of the beam scanning reflector 4 only when an arbitrary detection signal is input, and when the detection signal is not input, the control circuit 15 controls the beam scanning means driving circuit 13 so as not to emit the light to the photodetector device 6.

As one example, in the case of using an ON/OFF signal of a power source introduced to the present image display apparatus as the detection signal, it is possible to detect and correct the illumination characteristics relative to the driving current of each LED every time the power source is introduced to the present image display apparatus. Accordingly, it is possible to constantly detect luminance unevenness due to the individual characteristic deterioration by secular changes (changes with time) in each LED or each circuit constituent element, and the aforementioned luminance unevenness can be corrected at any time. However, when the ON/OFF signal of the power source mentioned above is used as the detection signal, the problem arises in that it takes an extremely long time between the instance when the power source is introduced to the present image display apparatus and the instance when correct images are displayed on the screen. The problem mentioned above can be solved easily by providing means for validating the detection signal only when luminance unevenness is adjusted or means for adjusting luminance unevenness every time when the present image display apparatus is used for several hundreds hours, for example, by a microcomputer or the like.

Furthermore, the same effect can be obtained by providing means for inputting the output from the control circuit 15 that is operated by the detection signal to the comparator 7 and conducting a comparative operation only when a correction of luminance unevenness is conducted, or also by providing means for inputting the output from the control circuit 15 to the storage element and updating the stored correction data only when luminance unevenness is corrected.

According to the configuration of the present invention described above, the conventional problem in that luminance unevenness is caused by the characteristic deterioration of each LED or each circuit part due to a secular change or the like is solved by providing the means for automatically correcting luminance unevenness of the present image display apparatus using an arbitrary detection signal, and the display image of the image display apparatus can be compensated. That is, an image display apparatus having little or no luminance unevenness at any time can be obtained.

Third Embodiment

Next, a third embodiment of the present invention will be described with reference to FIG. 5. In addition, the same reference numerals will be used for the same components as those in the aforementioned embodiments, and the explanations thereof will be omitted.

Figure 5:
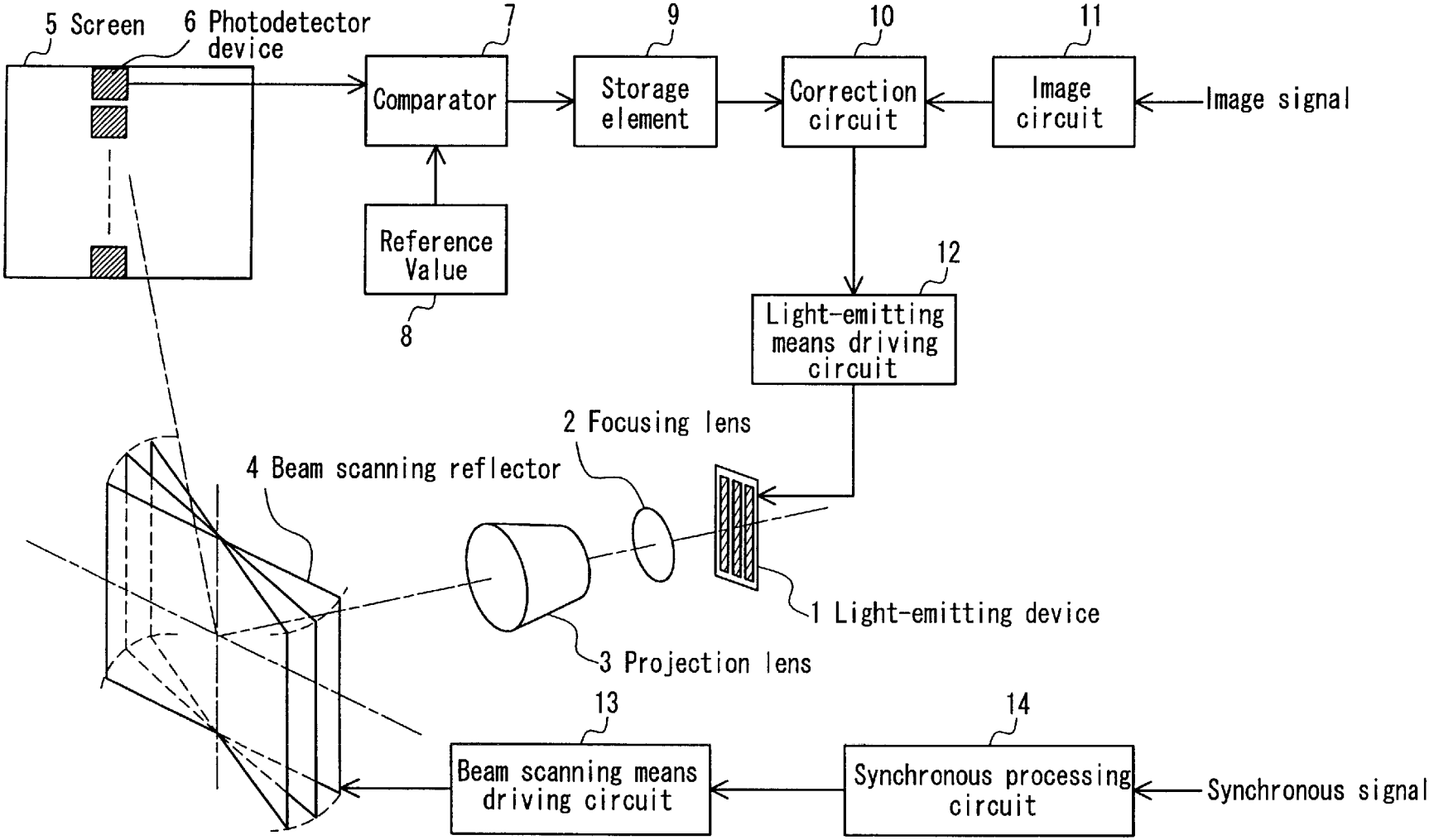
FIG. 5 is a block diagram of an image display apparatus according to a third embodiment of the present invention.

In FIG. 5, 5 is an adjustment screen for correction of luminance unevenness, and 6 is a photodetector device mounted on the adjustment screen for correction of luminance unevenness 5.

In the present embodiment, only when luminance unevenness of the present image display apparatus is adjusted, the adjustment screen for correction of luminance unevenness 5 mounted on the photodetector device 6 is applied to the position of the screen in the present image display apparatus, and luminance unevenness of each LED is corrected by the approach shown in the first embodiment mentioned above, and the correction data are stored in the storage element 9 located inside the present image display apparatus. Accordingly, it is no longer necessary to provide each photodetector element as standard equipment inside the present image display apparatus, so that the cost for the present image display apparatus can be reduced. Furthermore, since the photodetector device 6 can be mounted in the position of the screen, luminance unevenness can be corrected under the condition of practical use.

Furthermore, as illustrated in the first embodiment, according to the configuration of positioning the photodetector device 6 outside the screen, the light emitted from each LED mentioned above needs to be scanned up to the utmost exterior angle by the beam scanning reflector 4, so that the diameter of the light beam emitted to the photodetector element is enlarged slightly, and as a result thereof, there is a possibility of deteriorating the accuracy for detecting the intensity of the light. However, according to the configuration of the present embodiment, the photodetector device 6 can be arranged in a position that is closest from the beam scanning reflector 4, so that there is an advantage of improving the accuracy for detecting the intensity of the light, compared to the configuration in the first embodiment. Furthermore, the adjustment screen for correction of luminance unevenness 5 on which the photodetector device 6 is mounted does not have any benefit at all in the present embodiment, and the same effect can be obtained by using instead, for example, a plate on which the photodetector device 6 is mounted.

According to the configuration of the present invention described above, by providing a screen unit for adjustment of luminance unevenness, the cost for the present image display apparatus can be reduced, and there is also an effect of improving the accuracy for detecting the intensity of the light, compared to the configuration shown in the first embodiment.

In addition, the screen unit for adjustment of luminance unevenness may be provided to the body as standard equipment. In this case, the arrangement position of the photodetector device 6 should be variable, and the photodetector device 6 may be moved outside the effective image area of the screen 5 when images are displayed.

Fourth Embodiment

Figure 6:
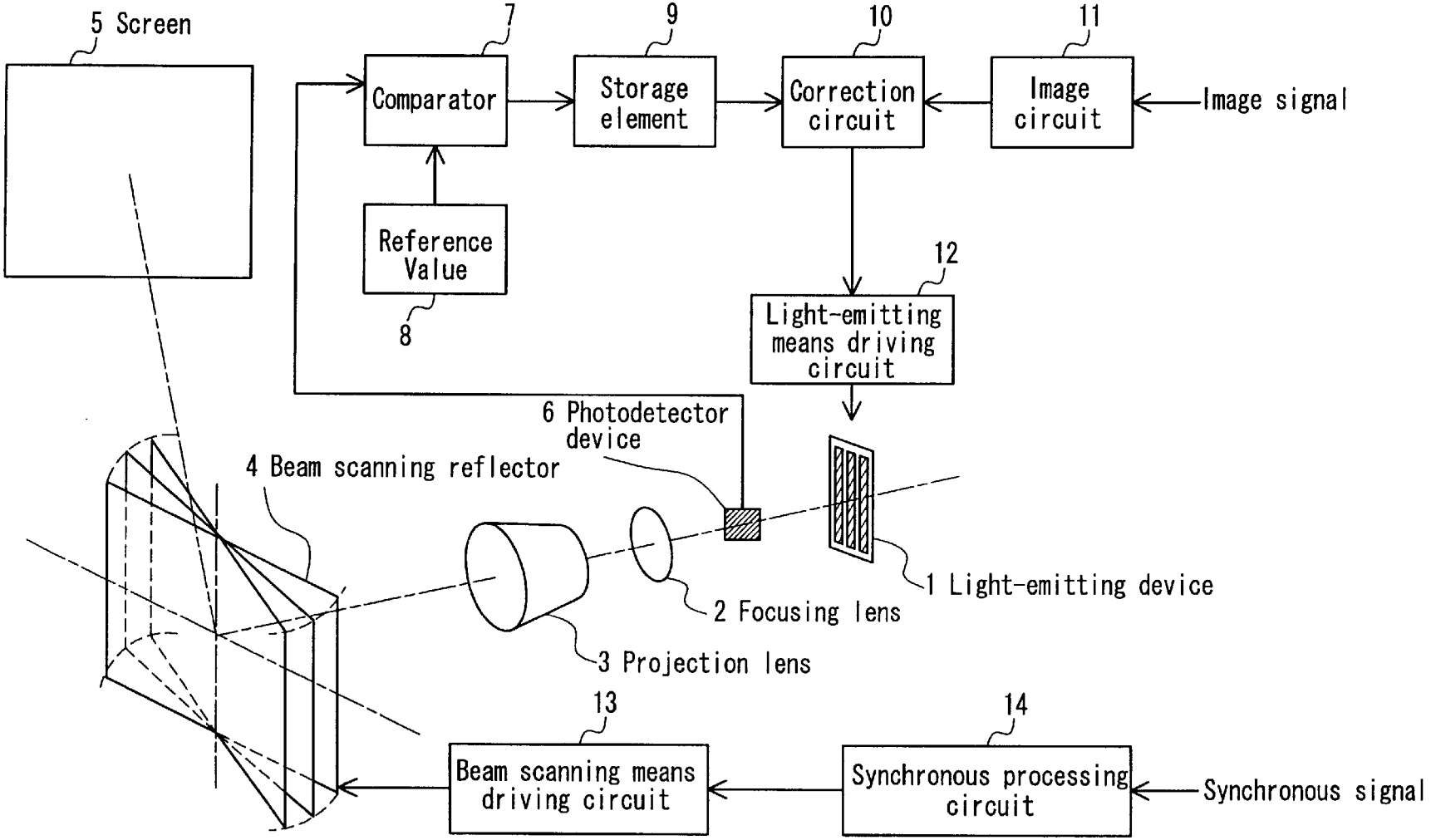
FIG. 6 is a block diagram of an image display apparatus according to a fourth embodiment of the present invention.

Next, a fourth embodiment of the present invention will be described with reference to FIG. 6. In addition, the same reference numerals will be used for the same components as those in the aforementioned embodiments, and the explanations thereof will be omitted.

In the configuration of the first embodiment, in order to correct luminance unevenness on the screen, the same number of photodetector elements for detection as that of each LED serving as a light-emitting source was required, which disadvantageously led to an increase in the cost for the present image display apparatus. Furthermore, due to the configuration of correcting luminance unevenness by using a plurality of photodetector elements, there was a problem in that means for correcting the variance between the respective photodetector elements must be provided separately.

Therefore, the present embodiment solved the aforementioned problem by positioning the photodetector device 6 in the vicinity of the focusing lens 2 only when luminance unevenness of the present image display apparatus is corrected, and correcting the luminance unevenness of each LED using the means as shown in the first embodiment. In other words, by positioning the photodetector device 6 near the focusing lens 2 that focuses the light emitted from each LED on one point, the apparatus can be constructed with one photodetector element. Accordingly, the number of man-hours for correcting the variance between the photodetector elements is no longer required. Furthermore, by always using the same photodetector element at the time when a delivery is adjusted, it is advantageous to suppress the variance of brightness between the image display apparatuses at the time of delivery.

According to the configuration described above, by providing a photodetector element unit for adjustment of luminance unevenness, the cost for the present image display apparatus can be reduced. Furthermore, since the apparatus can be constructed with one photodetector element for detection of luminance unevenness, the correction of the characteristic variance between the plurality of photodetector elements as shown in the first embodiment is no longer required, so that the number of man-hours for adjustment can be reduced significantly. Furthermore, since the photodetector element is arranged in the vicinity of the light-emitting device, this apparatus can be used not only for an integrated type rear projector with a screen included as standard equipment but can be extended also to a projection type projector not equipped with a screen.

In addition, the screen unit for adjustment of luminance unevenness may be provided separately from the body or included as standard equipment in the body. In the case of including it as standard equipment in the body, the arrangement position of the photodetector device 6 can be changed, and the photodetector device 6 may be moved outside the transmission range of the light when images are displayed.

Fifth Embodiment

Figure 7:
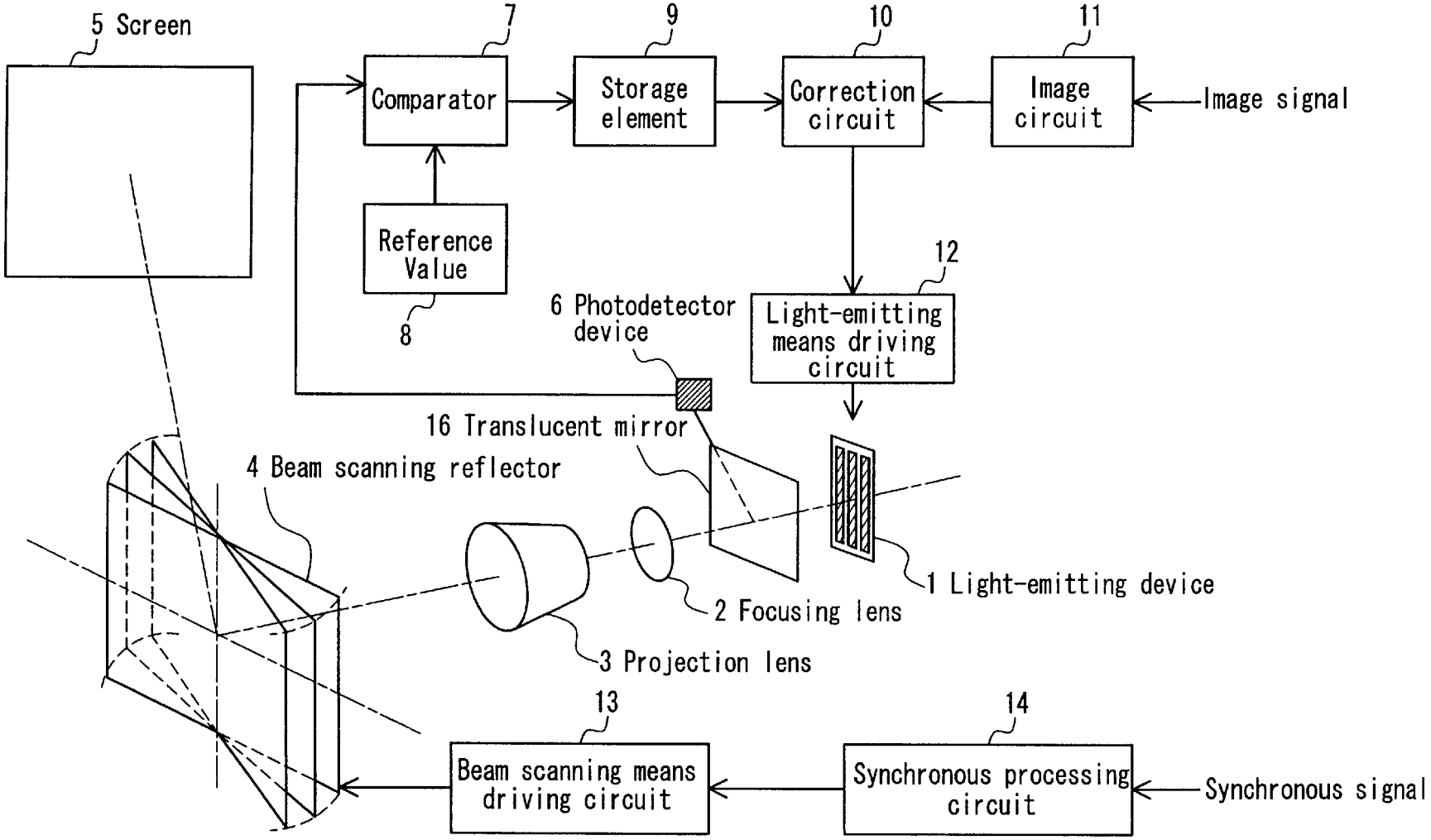
FIG. 7 is a block diagram of an image display apparatus according to a fifth embodiment of the present invention.

Next, a fifth embodiment of the present invention will be described with reference to FIG. 7. In addition, the same reference numerals will be used for the same components as those in the aforementioned embodiments, and the explanations thereof will be omitted.

In the present embodiment, 16 is a translucent mirror with a high light transmittance for providing a part of the light emitted from each LED to the photodetector device 6. The translucent mirror 16 is arranged in a position with a slight angle with respect to the optical axial direction of the light emitted from each LED to the focusing lens 2. Accordingly, the light emitted from each LED enters the translucent mirror 16, and most of the light is transmitted due to the high light transmittance of the translucent mirror 16 and focused on the focusing lens 2. However, a part of the light is reflected on the surface of the translucent mirror 16 due to an incident angle at the time of entering the translucent mirror 16, which enters the photodetector device 6 positioned in the vicinity of the translucent mirror 16. According to the configuration in which the translucent mirror 16 is positioned a stage prior to the focusing lens 2, the light reflected on the surface of the translucent mirror 16 is focused on one point with respect to the photodetector device 6. In other words, according to the configuration of the present invention, luminance unevenness of the image display apparatus can be corrected with one photodetector element. As a result, compared to the configuration shown in the first embodiment, the cost for the present image display apparatus can be reduced, and also a correction of the characteristic variance between the plurality of photodetector elements is no longer required, so that the number of man-hours for adjustment can be reduced significantly. Furthermore, the same effect can be obtained by positioning the translucent mirror 16 between the focusing lens 2 and the projection lens 3. In this case, however, the light reflected by the translucent mirror 16 moves in the scattering direction, so that the problem arises in that the photodetector device 6 must be enlarged.

According to the configuration of the present invention described above, by providing the translucent mirror with a high light transmittance, the cost for the image display apparatus can be reduced. Furthermore, since the apparatus can be constructed with one photodetector element for detection of luminance unevenness, the correction of the characteristic variance between the plurality of photodetector elements as in the configuration shown in the first embodiment is no longer required, and the number of man-hours for adjustment can be reduced significantly. Furthermore, by combining this configuration with that of the second embodiment, luminance unevenness caused by the deterioration such as a secular change of each element can be corrected constantly.

Sixth Embodiment

Figure 8:
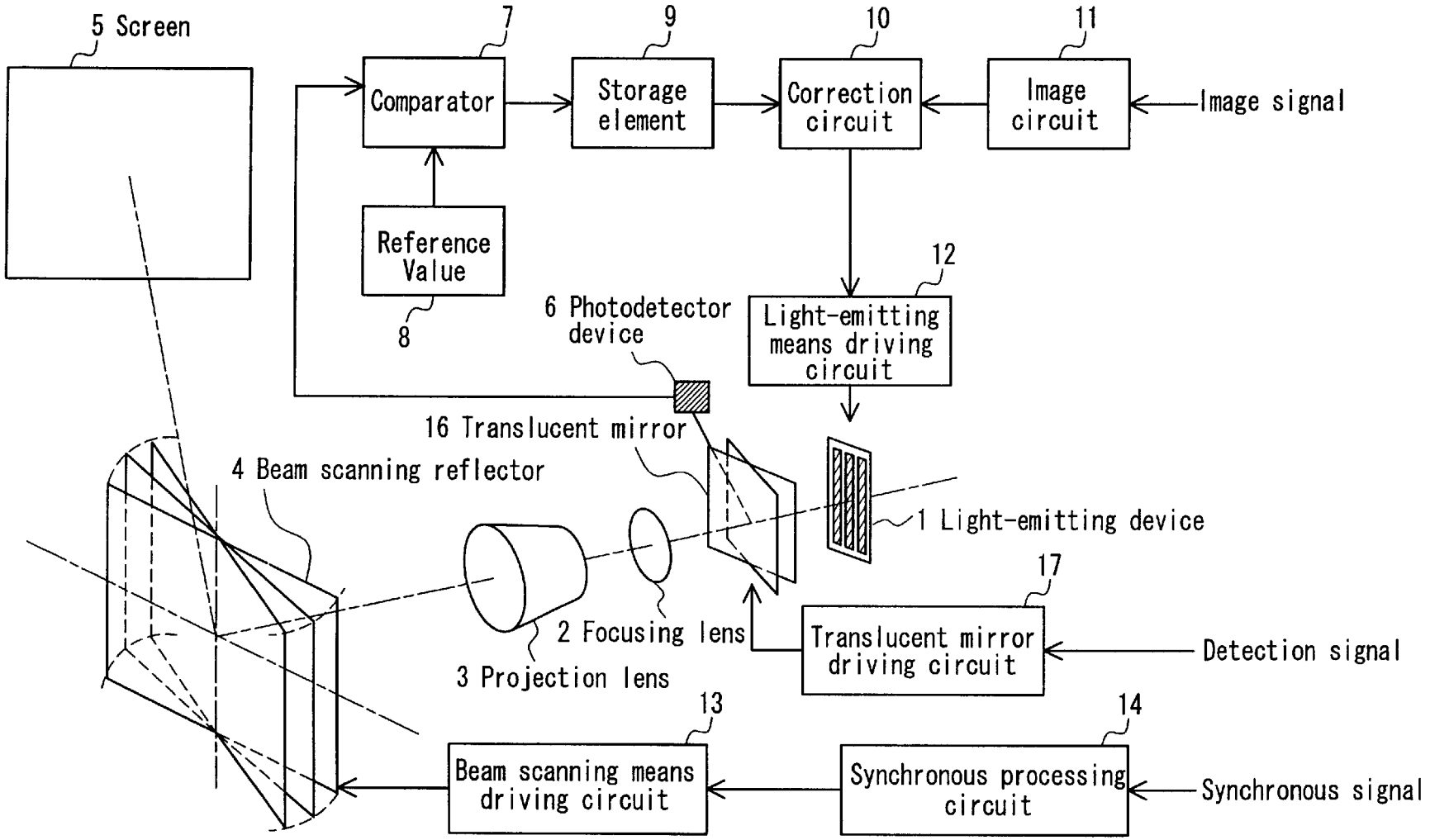
FIG. 8 is a block diagram of an image display apparatus according to a sixth embodiment of the present invention.

Next, a sixth embodiment of the present invention will be described with reference to FIG. 8. In addition, the same reference numerals will be used for the same components as those in the aforementioned embodiments, and the explanations thereof will be omitted.

In the configuration shown in the fifth embodiment, the light provided to the photodetector device 6 is dependent on the incident angle of the light entering the translucent mirror 16, and more light is provided to the photodetector element as the incident angle is larger. With respect to the accuracy for detecting the intensity of the light, the accuracy can be enhanced as the light entering the photodetector element is increased. However, there was a problem in that as the light emitted to the photodetector device 6 is increased, the luminance of the present image display apparatus is deteriorated. Furthermore, the light provided to the photodetector device 6 is different from the light projected on the screen, and as a result thereof, a problem such as deterioration of contrast arises in the present image display apparatus.

Therefore, according to the configuration of the present invention, by providing a translucent mirror driving circuit 17 for controlling the incident angle of the light entering the translucent mirror 16 by inputting an arbitrary detection signal, the aforementioned problem can be solved easily. That is, only when luminance unevenness of the present image display apparatus is adjusted, the light entering the translucent mirror 16 is provided with an incident angle, and in the ordinary case of displaying images, the incident angle of the light mentioned above is determined to be 0 degree. Due to this configuration, at the time when luminance unevenness is adjusted, as shown in the configuration of the fifth embodiment described above, the light is emitted to the photodetector device 6 so as to enable correction of any luminance unevenness, and in the ordinary case of projecting images on the screen, the incident angle of the light entering the translucent mirror 16 is 0 degree, so that the reflected light component also is 0. As a result, substantially 100% of the light can be focused on the focusing lens 2. Thus, the problem such as deterioration of contrast in the present image display apparatus according to the configuration of the fifth embodiment described above can be solved.

Furthermore, the detection signal for controlling the translucent mirror driving circuit 17 can be achieved, as shown in the configuration of the second embodiment, by an ON/OFF signal of a power source introduced into the present image display apparatus or the like.

According to the configuration of the present invention described above, compared to the configuration shown in the fifth embodiment, the problems such as deterioration of luminance or deterioration of contrast in images projected on the screen can be solved easily.

Seventh Embodiment

Figure 9:
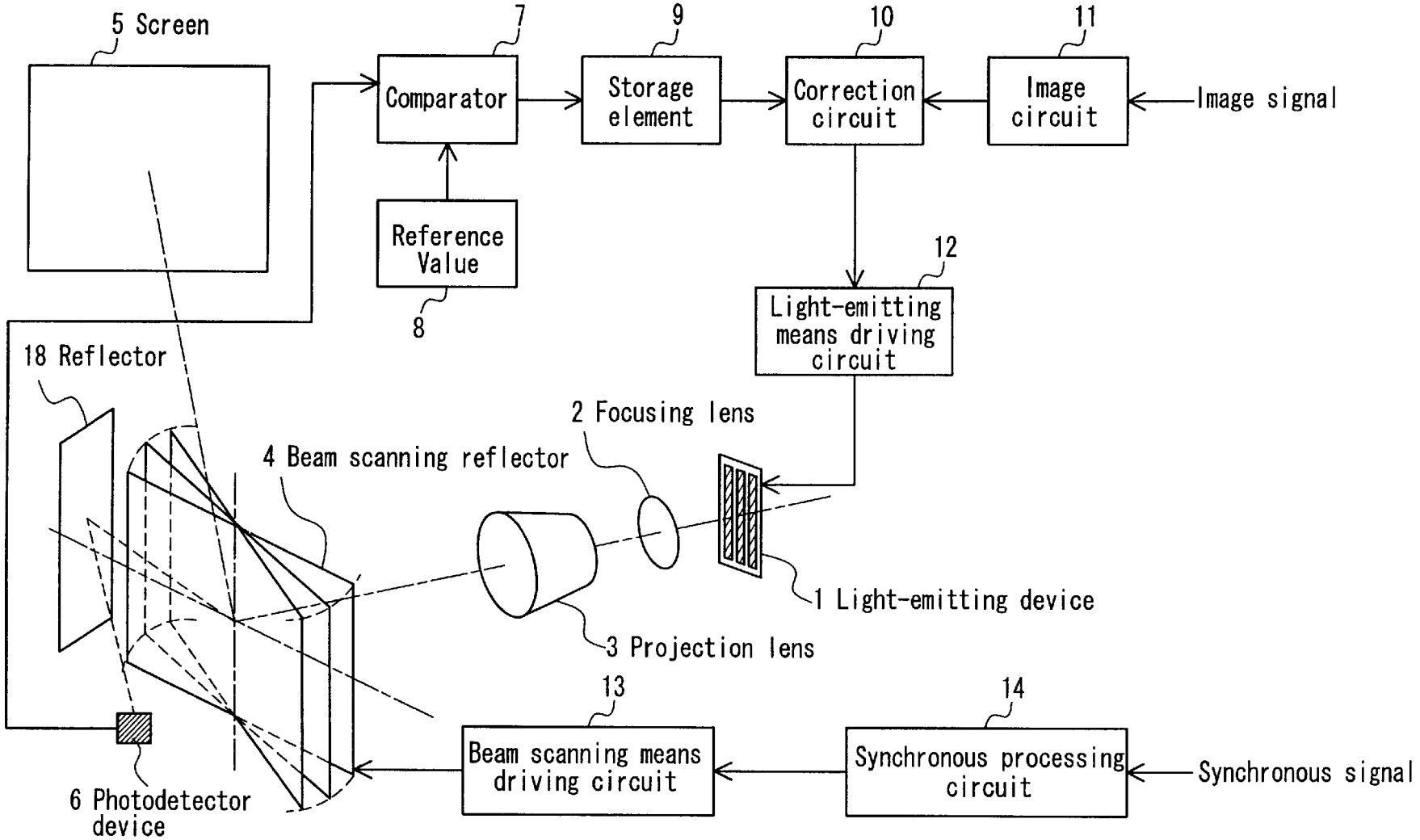
FIG. 9 is a block diagram of an image display apparatus according to a seventh embodiment of the present invention.

Next, a seventh embodiment of the present invention will be described with reference to FIG. 9. In addition, the same reference numerals will be used for the same components as those in the aforementioned embodiments, and the explanations thereof will be omitted.

In the configuration of the first embodiment, the photodetector device 6 is positioned outside on the screen, so that it was necessary to position a luminance unevenness correction circuit block including the photodetector device 6 outside the screen, which led to a problem of enlarging the casing for the present image display apparatus. Furthermore, when only the photodetector device 6 is positioned outside the screen and the luminance unevenness correction circuit block following the comparator 7 is positioned in a different area, there was a problem in that a wiring area for wiring the output of the photodetector device 6 was required.

The aforementioned problem is solved easily according to the configuration shown in the present embodiment. In FIG. 9, 18 is a reflector for focusing a part of the light scanned by the beam scanning reflector 4 and emitting it to the photodetector device 6. By emitting the light from the reflector 18 to the photodetector device 6, it is possible to correct luminance unevenness of the present image display apparatus as in the example shown in the first embodiment. According to the present embodiment, a part of the light scanned by the beam scanning reflector 4 can be provided to the photodetector element arranged in a back space of the beam scanning reflector 4 by means of the reflector 18. Due to this configuration, there is an advantage of achieving miniaturization of the casing for the present image display apparatus and also mounting the luminance unevenness correction circuit shown in the present image display apparatus on a projection type projector not equipped with a screen. Furthermore, by using a concave mirror as the reflector 18, the light scanned by the beam scanning reflector 4 can be focused on one point, and the present image display apparatus can be achieved with one photodetector device 6.

According to the configuration of the present invention described above, by providing means for emitting a part of the light scanned by the beam scanning reflector to the photodetector element by means of the reflector, the casing for the present image display apparatus can be miniaturized. Furthermore, since the apparatus can be constructed with one photodetector device 6, compared to the configuration of using a plurality of photodetector elements as shown in the first embodiment, means for correcting the characteristic variance between the photodetector elements is no longer necessary, so that the number of man-hours for adjustment can be reduced significantly.

Eighth Embodiment

Figure 10:
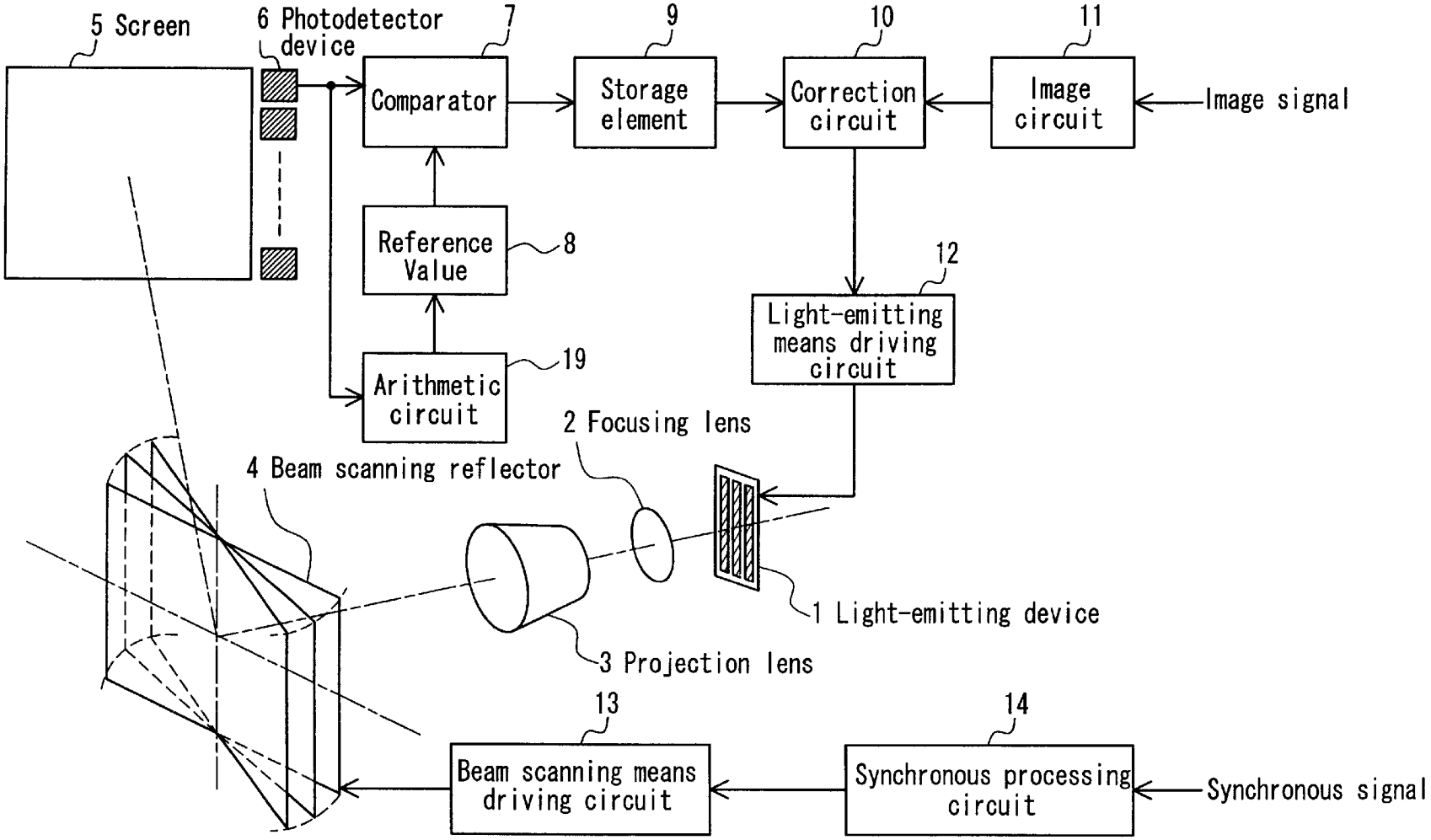
FIG. 10 is a block diagram of an image display apparatus according to an eighth embodiment of the present invention.

Next, an eighth embodiment of the present invention will be described with reference to FIG. 10. In addition, the same reference numerals will be used for the same components as those in the aforementioned embodiments, and the explanations thereof will be omitted.

In the configuration shown in the second embodiment, the problem of causing luminance unevenness in images projected on the screen due to the characteristic deterioration caused by a secular change of each LED or each circuit element could be solved by providing a control circuit to which an arbitrary detection signal is input. However, the emission luminance characteristics of the LED have the tendency of becoming darker in proportion to the emission time when the same driving current is supplied, and of having a shorter emission life as the amount of driving current is increased. In other words, when images with the same luminance are to be projected constantly on the screen, along with the increasing deterioration of the emission luminance characteristics of the LED, it is necessary to increase the amount of correction current to be provided to the LED, and as a result, there was a problem in that the emission life of the LED is shortened or deteriorated more quickly.

Therefore, according to the configuration of the present embodiment provided with an arithmetic circuit 19 for changing the value of the reference value 8 based on the intensity of the light in each LED emitted to the photodetector device 6, the aforementioned problem can be solved easily. Here, the reference value 8 changed by the arithmetic circuit 19 can be calculated, for example, by an average value of the intensity of the light in each LED input to the arithmetic circuit 19. In this case, there is an effect of suppressing the absolute value of the driving current amount to be corrected for each LED to minimum. Accordingly, the emission life of each LED can be lengthened, compared to the configuration of the second embodiment.

Furthermore, when the intensity of the light emitted from the LED is input for all the LED respectively to the arithmetic circuit 19 and the average value thereof is set to be the reference value 8, a problem occurs in that the computing time of the reference value 8 becomes longer in proportion to the number of the LED. Therefore, the aforementioned problem is solved easily by detecting the light intensity from several LED and calculating the reference value 8 in the same manner, instead of detecting the light intensity from all the LED. In this case, the detection accuracy is reduced as compared to the case of total detection, but since the emission luminance characteristics of the LED tend to become darker uniformly due to a secular change, there should be no problem in practical use ultimately to extract one LED as a representative and to reflect the result thereof in the reference value 8. In addition, by providing means for calculating the reference value 8 of the color of the LED serving as reference among three primary colors and automatically calculating the values of the other two colors on the basis of the reference value 8 serving as the reference, the white balance of images projected on the screen can be achieved, which also leads to a reduction of the computing time.

According to the configuration of the present invention described above, the problem arising in the configuration of the second embodiment in that the emission life of the LED is shortened more quickly is solved easily.

Ninth Embodiment

Next, a ninth embodiment of the present invention will be described with reference to FIG. 11. In addition, the same reference numerals will be used for the same components as those in the aforementioned embodiments, and the explanations thereof will be omitted.

Figure 11:
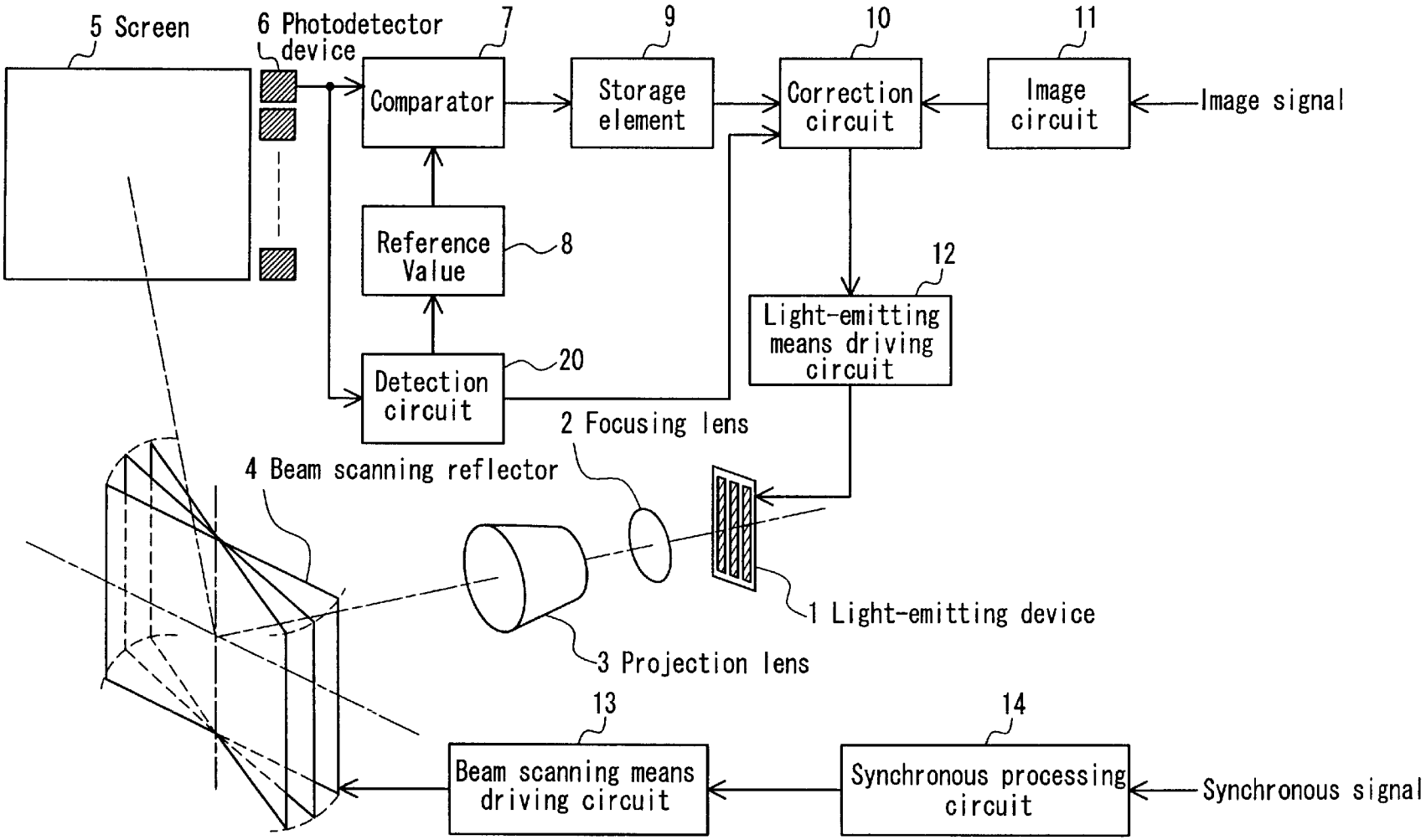
FIG. 11 is a block diagram of an image display apparatus according to a ninth embodiment of the present invention.

In FIG. 11, 20 is a detection circuit for correcting an arithmetic error of the correction circuit 10 by inputting the intensity of the light emitted to the photodetector device 6.

Figure 12:
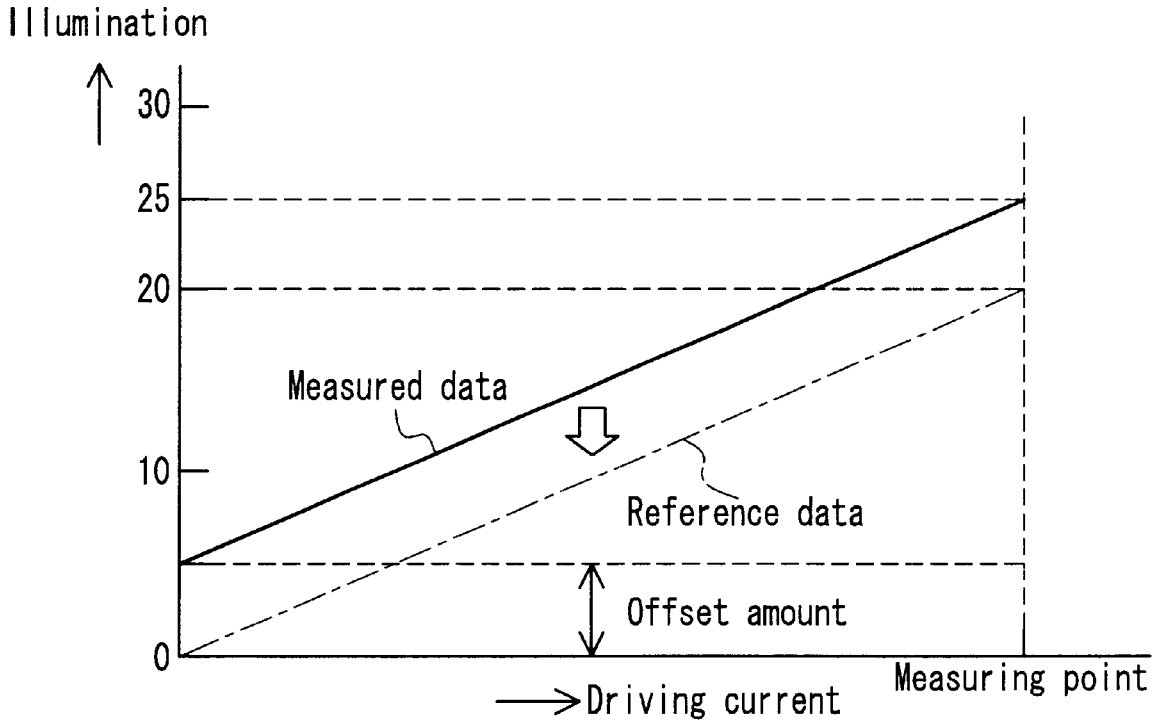
FIG. 12 is a graph for explaining the operation of the image display apparatus according to the ninth embodiment of the present invention.
Figure 13:
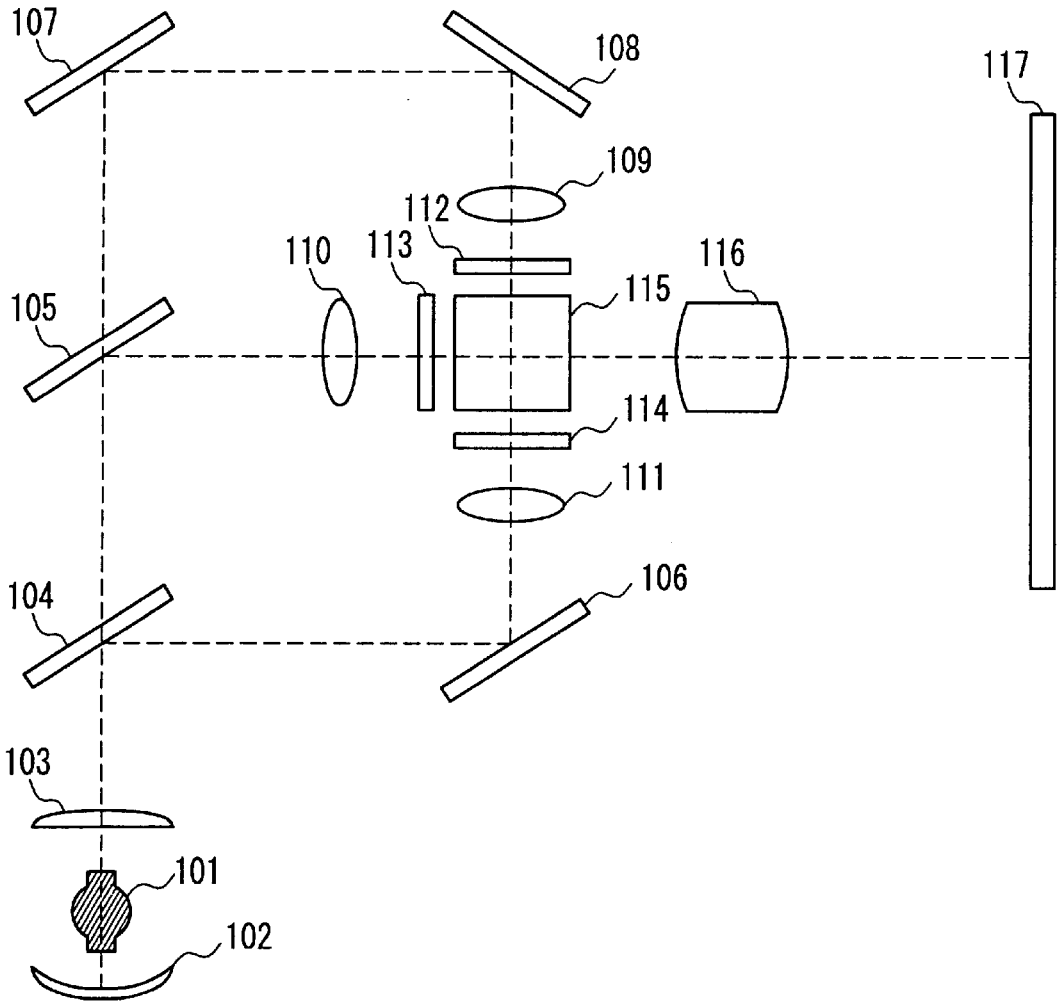
FIG. 13 (PRIOR ART)
FIG. 13 is a block diagram of a conventional image display apparatus.

Luminance unevenness arising in images projected from the present image display apparatus on the screen is corrected by the configuration shown in the first embodiment. Here, in the case of driving each LED with an analog current, the correction circuit 10 usually is constructed of an analog multiplier and a D/A converter, and as long as at least the LED is driven by an analog current, an analog arithmetic element is required. However, the analog arithmetic element has a DC offset component as shown in FIG. 12. Here, as shown in FIG. 12, in the case where the correction circuit 10 that drives the LED has a DC offset component equivalent to 5 lux in illumination, when the luminance unevenness is corrected according to the algorithm shown in the example of the first embodiment, the result that the intensity of the light in the LED at the measuring point is brighter than the reference value by 25% (5 lux) is obtained. Accordingly, the luminance of the picture signal supplied to the light-emitting means driving circuit 12 is 0.8 times as much as the luminance of the input picture signal. Thus, the same luminance is obtained for the driving current applied to the measuring point, but in the area where the driving current supplied to the LED is less, the luminance of the measuring element relative to the luminance of the LED serving as reference is brighter, so that the problem of causing unevenness in luminance arises.

To solve the aforementioned problem in the present embodiment, first, the light of all the LEDs is extinguished, and the emission luminance characteristics at this time are measured and the amount of DC offset (error component) superimposed on the correction circuit 10 is detected. The LED is a self-emitting element, so that when the driving current for the LED is set to be 0, the LED does not emit light in the ideal state. In other words, the intensity of the light detected by the photodetector device 6 at this time should be 0 lux. However, as shown in FIG. 12, when the DC offset component equivalent to 5 lux in illumination is superimposed on the correction circuit 10, the detection result of the photodetector device 6 that rightfully should be 0 lux is 5 lux. Thus, in this case, a signal equivalent to—5 lux in illumination is added constantly to the correction circuit 10, so that the DC offset component superimposed on the correction circuit 10 can be counterbalanced.

On the other hand, contrary to the example of FIG. 12, when the DC offset is superimposed in the negative direction (i.e. in the declining direction of luminance), the detection cannot be conducted only by detecting the illumination at the time when the driving current is 0. Therefore, by using the characteristics in that the illumination characteristics relative to the driving current of the LED are approximated by the linear function, the detection of illumination at a point different from the measuring point is conducted together with the detection of illumination at the measuring point, so that even if a DC offset component is superimposed on the negative direction side, this DC offset component can be detected. Furthermore, by using a high sensitivity photodetector element, the driving current to be supplied to the LED is allowed to be variable, and the same effect can be obtained also by using means for detecting the state in which the photodetector element is 0 lux.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. An image display apparatus comprising: light-emitting means including a plurality of light-emitting elements that modulate an intensity of a self-emitting light radiating respectively in red, green and blue according to an electric picture signal corresponding to information of images to be displayed, the light-emitting elements being arranged in a line according to each color, focusing means for focusing the light emitted from the light-emitting means, projection means for enlarging and projecting the light focused by the focusing means, beam scanning means for scanning the light projected by the projection means on a screen by a beam scanning means driving circuit, to which an output signal from a synchronous processing circuit is input, a synchronous signal being input from outside to the synchronous processing circuit, photodetector means having at least one photodetector element for receiving the light emitted from the light-emitting means, a comparator for comparing the individual intensity of the light, to which an intensity of the light received by the photodetector means is input on one side, and to which an intensity of a light serving as reference is input on the other side, a correction circuit for correcting an output signal from an image circuit, to which a picture signal synchronized with the synchronous signal is input based on the result of the comparator, and a light-emitting means driving circuit for driving the light-emitting means, to which an output from the correction circuit is input.

2. The image display apparatus according to claim 1, wherein the photodetector means is positioned outside an effective image area of the screen and receives the light scanned by the beam scanning means.

3. The image display apparatus according to claim 1, wherein the photodetector means includes a plurality of photodetector elements arranged in lines, and each of the photodetector elements receives a light for one set of red, green and blue light-emitting elements of the light-emitting means.

4. The image display apparatus according to claim 3, wherein light-emitting elements other than the light-emitting element involved in the light for the one set do not emit light when receiving the light for the one set.

5. The image display apparatus according to claim 3, wherein the photodetector element receives light from plural sets of light-emitting elements simultaneously by allowing one set of the light-emitting elements located in portions separated at a predetermined distance to emit light.

6. The image display apparatus according to claim 1, further comprising a control circuit for controlling the beam scanning means driving circuit, to which an arbitrary detection signal is input.

7. The image display apparatus according to claim 6, wherein the control circuit is a circuit that controls the beam scanning means driving circuit such that the light enlarged and projected by the projection means is emitted to the photodetector means by the beam scanning means when the detection signal is input, and controls the beam scanning means driving circuit so as not to emit the light to the photodetector means when the detection signal is not input.

8. The image display apparatus according to claim 6, wherein the beam scanning means driving circuit is controlled such that when the detection signal is input, and in the case where it is judged that a correction of an output signal from the image circuit is required, the light enlarged and projected by the projection means is emitted to the photodetector means by the beam scanning means.

9. The image display apparatus according to claim 1, wherein an arrangement position of the photodetector means can be changed, the photodetector means receiving the light scanned by the beam scanning means on the screen.

10. The image display apparatus according to claim 1, wherein an arrangement position of the photodetector means can be changed, the photodetector means receiving the light emitted from the light-emitting means in the vicinity of the focusing means.

11. The image display apparatus according to claim 1, further comprising means for inputting the light emitted from the light-emitting means to the photodetector means before the emitted light is enlarged and projected by the projection means.

12. The image display apparatus according to claim 11, wherein the means for inputting the emitted light to the photodetector means is a translucent mirror that transmits the light emitted from the light-emitting means to the focusing lens and provides a part of the light emitted from the light-emitting means to the photodetector means.

13. The image display apparatus according to claim 12, wherein the translucent mirror is positioned between the photodetector means and the focusing means.

14. The image display apparatus according to claim 13, wherein the translucent mirror is positioned such that when the light from the light-emitting means is provided to the photodetector means, the light from the light-emitting means enters the translucent mirror forming an incident angle with respect to the translucent mirror, and when the light from the light-emitting means is not provided to the photodetector means, the light from the light-emitting means forms an incident angle of 0 with respect to the translucent mirror.

15. The image display apparatus according to claim 12, further comprising a translucent mirror driving circuit for controlling the translucent mirror, to which an arbitrary detection signal is input.

16. The image display apparatus according to claim 1, further comprising a reflector for focusing the light scanned by the beam scanning means and emitting the light to the photodetector means.

17. The image display apparatus according to claim 16, wherein the photodetector means is positioned in a space on a side opposite to a reflecting surface of the light within a front and back space of the beam scanning means.

18. The image display apparatus according to claim 1, further comprising an arithmetic circuit which can change the intensity of the light serving as the reference, to which an output from the photodetector means is input.

19. The image display apparatus according to claim 18, wherein the arithmetic circuit calculates the intensity of the light serving as the reference based on a detection value of the intensity of the light detected from a part of the light-emitting elements among the light-emitting elements included in the light-emitting means.

20. The image display apparatus according to claim 1, further comprising a detection circuit, to which an output from the light-receiving means is input, and from which the result thereof is output to the correction circuit.

21. The image display apparatus according to claim 20, wherein light-emitting elements of the light-emitting means are driven by an analog current, and the correction circuit adds a signal for counterbalancing a DC offset component superimposed on the correction circuit based on the output from the detection circuit in a state in which the light of all the light-emitting elements of the photodetector means is extinguished.

22. The image display apparatus according to claim 1, wherein the light-emitting element is selected from a light-emitting diode element, an electroluminescence element, and a semiconductor element.

23. The image display apparatus according to claim 1, wherein the beam scanning means uses a reflector or a prism for changing a direction of a light beam.

24. A method for compensating display images of an image display apparatus comprising: light-emitting means including a plurality of light-emitting elements that modulate an intensity of a self-emitting light radiating respectively in red, green and blue according to an electric picture signal corresponding to information of images to be displayed, the light-emitting elements being arranged in a line according to each color, focusing means for focusing the light emitted from the light-emitting means, projection means for enlarging and projecting the light focused by the focusing means, beam scanning means for scanning the light projected by the projection means on a screen by a beam scanning means driving circuit, to which an output signal from a synchronous processing circuit is input, a synchronous signal being input from outside to the synchronous processing circuit, and a light-emitting means driving circuit for driving the light-emitting means, the method comprising receiving the light emitted from the light-emitting means by using photodetector means having at least one photodetector element, comparing the individual intensity of the light, to which an intensity of the light received by the photodetector means is input on one side, and to which an intensity of a light serving as reference is input on the other side, correcting an output signal from an image circuit, to which a picture signal synchronized with the synchronous signal is input based on the result of comparison, and driving the light-emitting means by the light-emitting means driving circuit, to which the corrected output signal is input.

25. The method for compensating display images of an image display apparatus according to claim 24, wherein the photodetector means receives the light on the screen.

26. The method for compensating display images of an image display apparatus according to claim 24, wherein the photodetector means includes a plurality of photodetector elements arranged in lines, and each of the photodetector elements receives a light for one set of red, green and blue light-emitting elements of the light-emitting means.

27. The method for compensating display images of an image display apparatus according to claim 24, wherein the photodetector means receives the light in the vicinity of the focusing means.

* * * * *